US008453614B2

(12) United States Patent
Imamura et al.

(10) Patent No.: US 8,453,614 B2
(45) Date of Patent: Jun. 4, 2013

(54) VARIABLE VALVE TIMING DEVICE FOR INTERNAL COMBUSTION ENGINE AND MANUFACTURING METHOD THEREFOR

(75) Inventors: Toshio Imamura, Okazaki (JP); Akihiko Takenaka, Anjo (JP)

(73) Assignees: Toyota Jidosha Kabushiki Kaisha, Toyota (JP); Denso Corporation, Kariya (JP)

( * ) Notice: Subject to any disclaimer, the term of this patent is extended or adjusted under 35 U.S.C. 154(b) by 177 days.

(21) Appl. No.: 13/164,334

(22) Filed: Jun. 20, 2011

(65) Prior Publication Data

US 2011/0315104 A1 Dec. 29, 2011

(30) Foreign Application Priority Data

Jun. 25, 2010 (JP) ..... 2010-144978

(51) Int. Cl.
*F01L 1/34* (2006.01)

(52) U.S. Cl.
USPC ..... 123/90.15; 123/90.17; 464/160

(58) Field of Classification Search
USPC ..... 123/90.15, 90.17; 464/1, 2, 160
See application file for complete search history.

(56) References Cited

U.S. PATENT DOCUMENTS 7,506,622 B2 * 3/2009 Takahashi et al. ..... 123/90.15

FOREIGN PATENT DOCUMENTS

JP A-2002-004816 1/2002
JP A-2002-357105 12/2002

* cited by examiner

*Primary Examiner* — Ching Chang
(74) *Attorney, Agent, or Firm* — Oliff & Berridge, PLC

(57) ABSTRACT

A variable valve timing device for an internal combustion engine includes: a variable valve timing mechanism that changes a valve timing; and a phase limiting mechanism that locks a rotational phase between a housing rotor and a vane rotor at an intermediate phase. The phase limiting mechanism engages a first limiting pin with a first engaging groove and engages a second limiting pin with a second engaging groove to lock the housing rotor to the vane rotor. A retard-side side surface of an engaging hole is configured so as to be able to adjust a clearance between the second limiting pin and the retard-side side surface when the first limiting pin is engaged with a first advance end portion.

6 Claims, 10 Drawing Sheets

COMPARATIVE EXAMPLE

COMPARATIVE EXAMPLE

VARIABLE VALVE TIMING DEVICE FOR INTERNAL COMBUSTION ENGINE AND MANUFACTURING METHOD THEREFOR

INCORPORATION BY REFERENCE

The disclosure of Japanese Patent Application No. 2010-144978 filed on Jun. 25, 2010 including the specification, drawings and abstract is incorporated herein by reference in its entirety.

BACKGROUND OF THE INVENTION

1. Field of the Invention

The invention relates to a variable valve timing device for an internal combustion engine, which includes a variable valve timing mechanism that changes the valve timing of at least one of an intake valve and an exhaust valve that serve as engine valves and a phase limiting mechanism that locks a relative rotational phase between an input rotor and an output rotor that constitute the variable valve timing mechanism at a specific phase, and a manufacturing method for the variable valve timing device.

2. Description of Related Art

The variable valve timing device is, for example, known as the one described in Japanese Patent Application Publication No. 2002-357105 (JP-A-2002-357105). A phase limiting mechanism of the variable valve timing device includes an advance limiting mechanism and a retard limiting mechanism. The advance limiting mechanism limits a change of the relative rotational phase of an output rotor with respect to an input rotor toward an advance side with respect at a specific phase. The retard limiting mechanism limits a change of the rotational phase toward a retard side with respect to the specific phase. In addition, the phase limiting mechanism includes a locking mechanism that locks the relative rotational phase of the output rotor with respect to the input rotor at the specific phase. The locking mechanism engages an engaging element provided for the output rotor with an engaging hole provided for the input rotor to lock the relative rotational phase between the output rotor and the input rotor.

Incidentally, other than the above locking mechanism, a mechanism that locks the output rotor at a specific phase with respect to the input rotor as described above is conceivably configured to lock the input rotor and the output rotor at a specific phase by the cooperation of the advance limiting mechanism and the retard limiting mechanism. Specifically, when the relative rotational phase of the output rotor with respect to the input rotor is a specific phase, the engaging element of the advance limiting mechanism contacts an advance-side engaging portion of an engaging groove to limit advance of the relative rotational phase, and the engaging element of the retard limiting mechanism contacts a retard-side engaging portion of the engaging groove to limit retard of the relative rotational phase.

However, according to the above phase limiting mechanism, if the distance in the circumferential direction between the two engaging elements is shorter than the distance in the circumferential direction between the two engaging portions, one of the engaging elements does not fit the engaging groove. In addition, when the phase interval between the two engaging elements is longer than the distance in the circumferential direction between the two engaging portions, a clearance is formed between one of the engaging elements and a corresponding one of the engaging portions. If the clearance is too large, collision noise problematically occurs because of a collision between one of the engaging elements and a corresponding one of the engaging portions.

SUMMARY OF THE INVENTION

The invention provides a variable valve timing device for an internal combustion engine, which includes a phase limiting mechanism that locks an input rotor to an output rotor by the cooperation of a retard limiting mechanism and an advance limiting mechanism and that is able to adjust the clearance between an engaging element and an engaging portion, and a manufacturing method for the variable valve timing device.

A first aspect of the invention provides a variable valve timing device for an internal combustion engine. The variable valve timing device includes: a variable valve timing mechanism that includes an input rotor and an output rotor and that changes a valve timing of at least one of an intake valve and an exhaust valve that serve as engine valves; and a phase limiting mechanism that includes an advance limiting mechanism that engages a first engaging element with a first engaging portion of a first engaging groove to limit rotation of the output rotor toward an advance side beyond a specific phase with respect to the input rotor and a retard limiting mechanism that engages a second engaging element with a second engaging portion of a second engaging groove to limit rotation of the output rotor toward a retard side beyond the specific phase with respect to the input rotor, and that locks a relative rotational phase between the input rotor and the output rotor at the specific phase by the engagement of the first engaging element with the first engaging portion and the engagement of the second engaging element with the second engaging portion, wherein the phase limiting mechanism includes at least one of the second engaging portion that is configured to be able to adjust a clearance between the second engaging element and the second engaging portion when the first engaging element engages the first engaging portion and the first engaging portion that is configured to be able to adjust a clearance between the first engaging element and the first engaging portion when the second engaging element engages the second engaging portion.

According to the above aspect, the second engaging portion is configured to be able to adjust the clearance between the second engaging element and the second engaging portion when the first engaging element engages the first engaging portion, so it is possible to adjust the clearance when the variable valve timing mechanism is assembled. In addition, the first engaging portion is configured to be able to adjust the clearance between the first engaging element and the first engaging portion when the second engaging element engages the second engaging portion, so it is possible to adjust the clearance when the variable valve timing mechanism is assembled.

A second aspect of the invention provides a manufacturing method for a variable valve timing device for an internal combustion engine. The variable valve timing device includes a variable valve timing mechanism that changes a valve timing of at least one of an intake valve and an exhaust valve that serve as engine valves; and a phase limiting mechanism that includes an advance limiting mechanism that engages a first engaging element with a first engaging portion of a first engaging groove to limit rotation of an output rotor toward an advance side beyond a specific phase with respect to an input rotor and a retard limiting mechanism that engages a second engaging element with a second engaging portion of a second engaging groove to limit rotation of the output rotor toward a retard side beyond the specific phase with respect to the input rotor, and that locks a relative rotational phase between the input rotor and the output rotor at the specific phase by the engagement of the first engaging element with the first engaging portion and the engagement of the second engaging element with the second engaging portion, wherein the phase limiting mechanism includes part of the second engaging portion as a detachable member that is formed separately from an adjustable rotor, which is one of the input rotor and the output rotor having the second engaging portion, and allows a thickness of the detachable member to be changed to thereby change a distance between the first engaging portion and the second engaging portion. The manufacturing method includes: engaging the first engaging portion with the first engaging element; after the first engaging portion is engaged with the first engaging element, measuring a distance between an end surface, adjacent to the first engaging element, of the second engaging portion, from which the detachable member is detached, and the second engaging element as a distance difference; after the distance difference is measured, selecting the detachable member having the thickness appropriate for the distance difference from among detachable members of different types; and assembling the selected detachable member to the adjustable rotor.

According to the above aspect, part of the second engaging portion is formed as the detachable member that is formed separately from the adjustable rotor. Then, the thickness of the detachable member is changed to change the distance between the first engaging portion and the second engaging portion. Thus, the distance between the first engaging portion and the second engaging portion is adjusted, so it is possible to adjust the clearance between the second engaging portion and the second engaging element.

A third aspect of the invention provides a manufacturing method for a variable valve timing device for an internal combustion engine. The variable valve timing device includes a variable valve timing mechanism that changes a valve timing of at least one of an intake valve and an exhaust valve that serve as engine valves; and a phase limiting mechanism that includes an advance limiting mechanism that engages a first engaging element with a first engaging portion of a first engaging groove to limit rotation of an output rotor toward an advance side beyond a specific phase with respect to an input rotor and a retard limiting mechanism that engages a second engaging element with a second engaging portion of a second engaging groove to limit rotation of the output rotor toward a retard side beyond the specific phase with respect to the input rotor, and that locks a relative rotational phase between the input rotor and the output rotor at the specific phase by the engagement of the first engaging element with the first engaging portion and the engagement of the second engaging element with the second engaging portion, wherein the phase limiting mechanism includes part of the first engaging portion as a detachable member that is formed separately from an adjustable rotor, which is one of the input rotor and the output rotor having the first engaging portion, and allows a thickness of the detachable member to be changed to thereby change a distance between the first engaging portion and the second engaging portion. The manufacturing method includes: engaging the second engaging portion with the second engaging element; after the second engaging portion is engaged with the second engaging element, measuring a distance between an end surface, adjacent to the second engaging element, of the first engaging portion, from which the detachable member is detached, and the first engaging element as a distance difference; after the distance difference is measured, selecting the detachable member having the thickness appropriate for the distance difference from among detachable members of different types; and assembling the selected detachable member to the adjustable rotor.

According to the above aspect, part of the first engaging portion is formed as the detachable member that is formed separately from the adjustable rotor. Then, the thickness of the detachable member is changed to change the distance between the first engaging portion and the second engaging portion. Thus, the distance between the first engaging portion and the second engaging portion is adjusted, so it is possible to adjust the clearance between the first engaging portion and the first engaging element.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
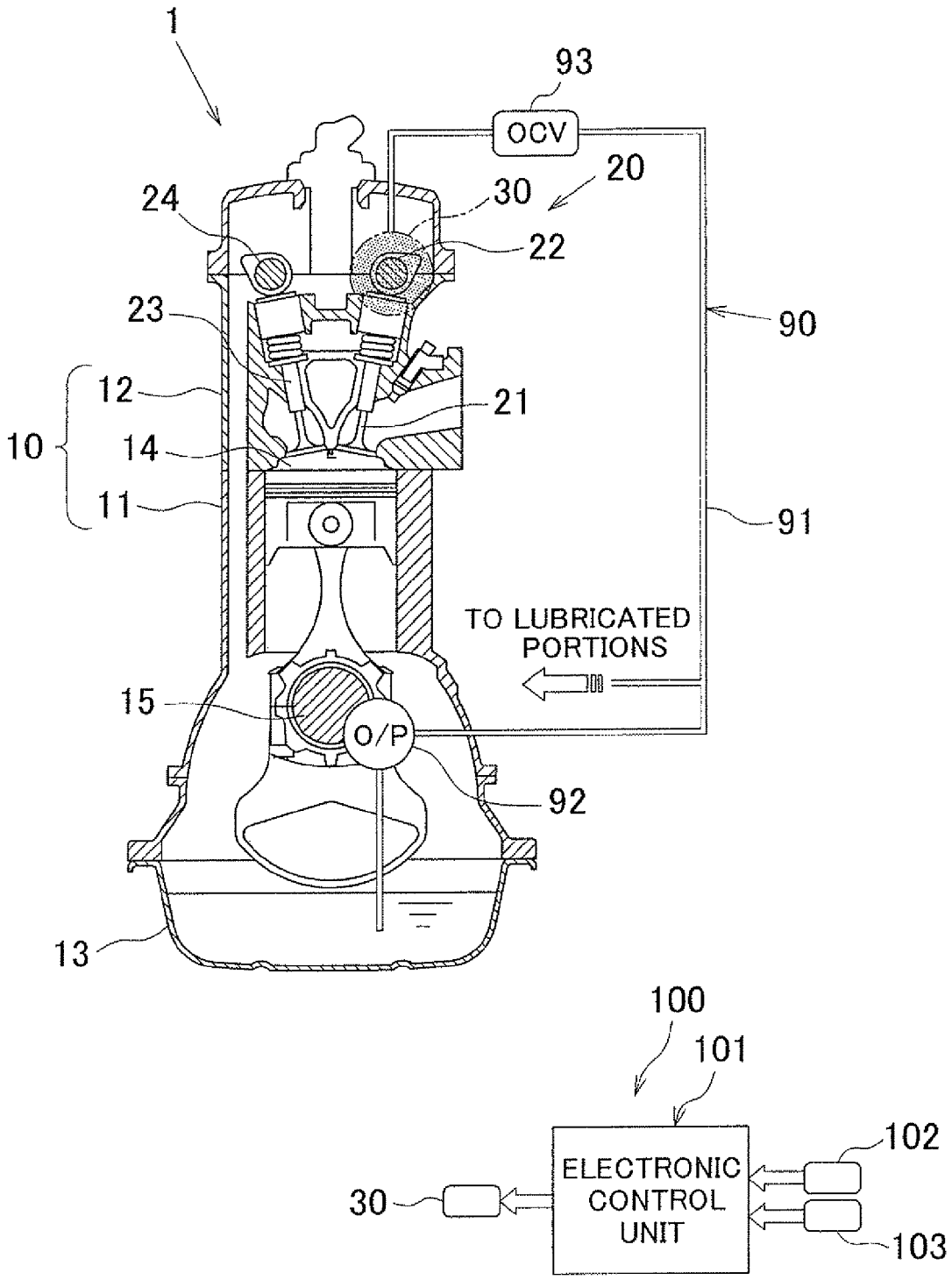
FIG. 1 is a schematic view that schematically shows the structure of an internal combustion engine equipped with a variable valve timing device according to an embodiment of the invention.

An embodiment of the invention will be described with reference to FIG. 1 to FIG. 9. As shown in FIG. 1, an internal combustion engine 1 includes an engine body 10, a variable valve timing device 20, a lubricating device 90 and a controller 100. The engine body 10 includes a cylinder block 11 and a cylinder head 12. The variable valve timing device 20 changes the open/close timing of an intake valve 21. The lubricating device 90 supplies lubricating oil to the engine body 10, and the like. The controller 100 comprehensively controls these devices.

The variable valve timing device 20 is formed of the intake valve 21, an exhaust valve 23, an intake camshaft 22, an exhaust camshaft 24 and a variable valve timing mechanism 30. The intake valve 21 and the exhaust valve 23 open or close a combustion chamber 14. The intake camshaft 22 and the exhaust camshaft 24 respectively push down these valves. The variable valve timing mechanism 30 changes the rotational phase (hereinafter, "valve timing VT") of the intake camshaft 22 with respect to the rotational phase of a crankshaft 15.

The lubricating device 90 includes an oil pump 92, a lubricating oil passage 91 and an oil control valve 93. The oil pump 92 discharges lubricating oil in an oil pan 13. The lubricating oil passage 91 supplies lubricating oil discharged from the oil pump 92 to various portions of the internal combustion engine 1. The oil control valve 93 controls a mode in which lubricating oil is supplied to the variable valve timing mechanism 30.

The controller 100 includes an electronic control unit 101 and various sensors, such as a crank position sensor 102 and a cam position sensor 103. The electronic control unit 101 executes various processings, and the like, for controlling the internal combustion engine 1. One of controls executed by the electronic control unit 101 is valve timing control in which the valve timing VT is changed through control over the variable valve timing mechanism 30. The valve timing VT is calculated on the basis of a signal from the crank position sensor 102 and a signal from the cam position sensor 103.

In the valve timing control, the valve timing VT is changed between the most advanced valve timing VT (hereinafter, "most advanced timing VTmax") and the most retarded valve timing VT (hereinafter, "most retarded timing VTmin") on the basis of an engine load and an engine operating state. In addition, when the internal combustion engine 1 is stopped, the valve timing VT is changed to a specific timing VT (hereinafter, "intermediate timing VTmdl") between the most advanced timing VTmax and the most retarded timing VTmin.

Figure 2A:
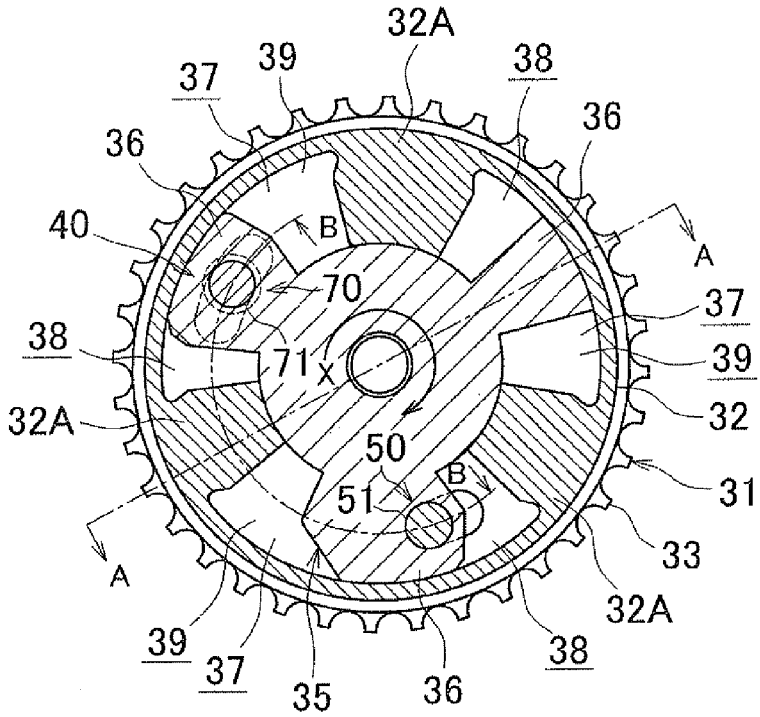
FIG. 2A is a cross-sectional view that shows the cross-sectional structure of a variable valve timing mechanism according to the embodiment.
Figure 2B:
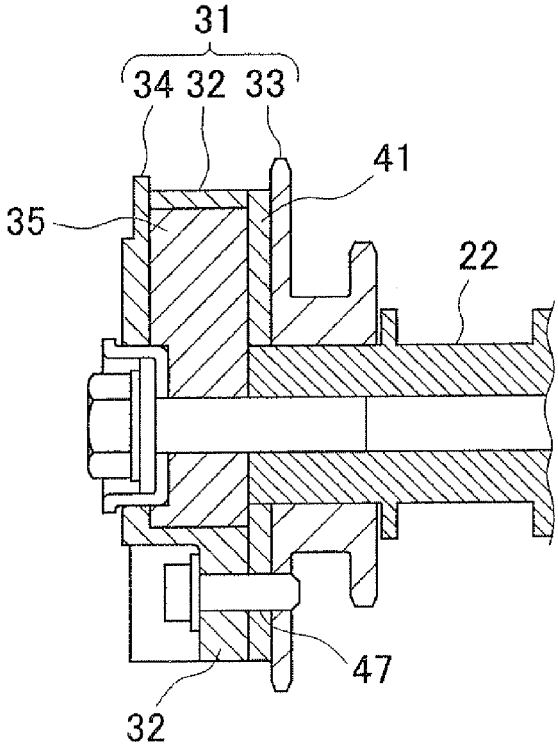
FIG. 2B is a cross-sectional view that shows the cross-sectional structure of the variable valve timing mechanism according to the embodiment, taken along the line A-A in FIG. 2A.

The variable valve timing mechanism 30 will be described with reference to FIG. 2A and FIG. 2B. Note that the arrow X in FIG. 2A indicates the rotational direction X of a sprocket 33 (crankshaft 15) and intake camshaft 22.

The variable valve timing mechanism 30 includes a housing rotor 31, a vane rotor 35 and a phase limiting mechanism 40. The housing rotor 31 rotates in synchronization with the crankshaft 15. The vane rotor 35 rotates in synchronization with the intake camshaft 22. The phase limiting mechanism 40 locks the valve timing VT at the intermediate timing VTmdl.

Hereinafter, the valve timing VT at which the relative rotational phase of the vane rotor 35 is set at the most retarded phase PB is the most retarded timing VTmin. In addition, the valve timing VT at which the relative rotational phase of the vane rotor 35 is set at the most advanced phase PA is the most advanced timing VTmax. In addition, the valve timing VT at which the relative rotational phase of the vane rotor 35 is set at the intermediate phase PM (specific phase) is the intermediate timing VTmdl.

The housing rotor 31 includes the sprocket 33, an engaging plate 41, a housing body 32 and a cover 34. The sprocket 33 is coupled to the crankshaft 15 via a timing chain. The engaging plate 41 is assembled to the sprocket 33. The housing body 32 is assembled to the engaging plate 41 and the sprocket 33, and rotates integrally with the sprocket 33. The cover 34 is connected to the housing body 32. The housing body 32 has three partition walls 32A that radially protrude toward the rotary shaft (intake camshaft 22) of the housing rotor 31.

The vane rotor 35 is fixed to an end of the intake camshaft 22, and is arranged in a space inside the housing body 32. The vane rotor 35 has three vanes 36 that protrude into respective vane accommodating chambers 37. The vane accommodating chambers 37 each are formed between the adjacent partition walls 32A of the housing body 32. Each vane accommodating chamber 37 formed between the adjacent partition walls 32A is partitioned by a corresponding one of the vanes 36 into an advance chamber 38 and a retard chamber 39.

Each advance chamber 38 is located rearward in the rotational direction X of the intake camshaft 22 with respect to the vane 36 inside the vane accommodating chamber 37. Each retard chamber 39 is located forward in the rotational direction X of the intake camshaft 22 with respect to the vane 36 inside the vane accommodating chamber 37. The advance chambers 38 and the retard chambers 39 expand or contract in accordance with a state where lubricating oil is supplied to or drained from the variable valve timing mechanism 30 by the oil control valve 93.

When lubricating oil is supplied to the advance chambers 38 and drained from the retard chambers 39, the vane rotor 35 rotates toward an advance side with respect to the housing rotor 31, that is, in the rotational direction X of the intake camshaft 22, and the valve timing VT changes to be advanced. When the vane rotor 35 fully rotates toward the advance side with respect to the housing rotor 31, that is, when the relative rotational phase of the vane rotor 35 is set at the most forward rotational phase in the rotational direction X, the valve timing VT is set at the most advanced timing VTmax.

When lubricating oil is drained from the advance chambers 38 and supplied to the retard chambers 39, the vane rotor 35 rotates toward a retard side with respect to the housing rotor 31, that is, in a direction opposite to the rotational direction X of the intake camshaft 22, and the valve timing VT changes to be retarded. When the vane rotor 35 fully rotates toward the retard side with respect to the housing rotor 31, that is, when the relative rotational phase of the vane rotor 35 is set at the most rearward rotational phase in the rotational direction X, the valve timing VT is set at the most retarded timing VTmin.

Figure 3:
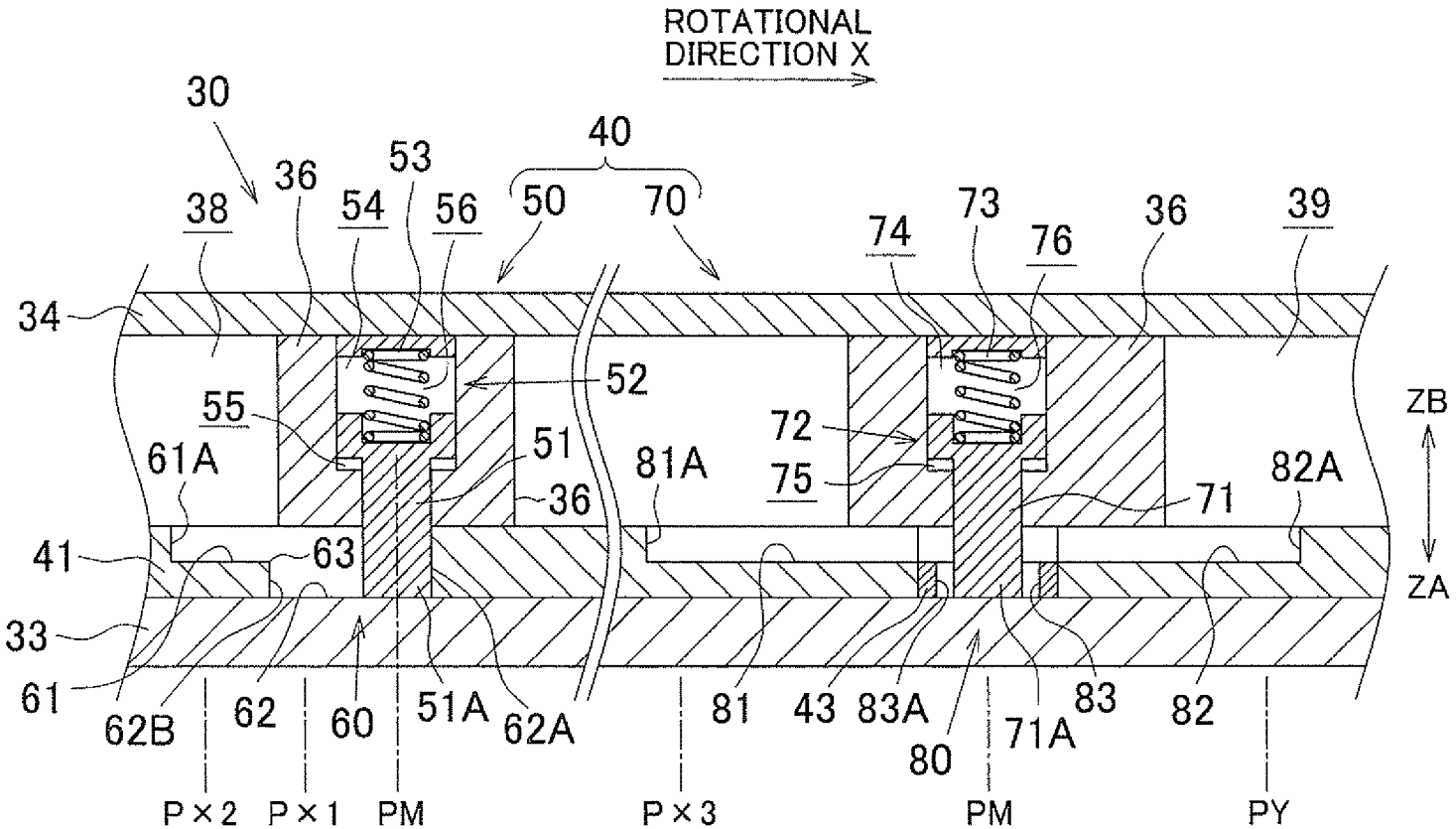
FIG. 3 is a cross-sectional view that shows the cross-sectional structure of the variable valve timing mechanism according to the embodiment, taken along the line B-B in FIG. 2A.

The structure of the phase limiting mechanism 40 will be described with reference to FIG. 3. The phase limiting mechanism 40 includes an advance limiting mechanism 50 and a retard limiting mechanism 70. The advance limiting mechanism 50 limits rotation of the vane rotor 35 to an advance-side rotational phase beyond the intermediate phase PM with respect to the housing rotor 31. The retard limiting mechanism 70 limits rotation of the vane rotor 35 to a retard-side rotational phase beyond the intermediate phase PM with respect to the housing rotor 31. In addition, the phase limiting mechanism 40 has the function of locking the valve timing VT at a specific valve timing VT (hereinafter, "intermediate timing VTmdl").

The advance limiting mechanism 50 includes a first limiting pin 51, a first limiting portion 52 and a first engaging groove 60. The first limiting pin 51 is provided for one of the vanes 36 so as to be displaceable with respect to the vane 36. The first limiting portion 52 actuates the first limiting pin 51 with respect to the vane 36. The first engaging groove 60 engages the first limiting pin 51. The first limiting portion 52 includes a first accommodating chamber 54 and a first limiting spring 53. The first accommodating chamber 54 is formed in the vane 36. The first limiting spring 53 presses the first limiting pin 51 in one direction. The first accommodating chamber 54 includes a first spring chamber 56 and a first limiting chamber 55. The first spring chamber 56 accommodates the first limiting spring 53. The first limiting chamber 55 receives lubricating oil supplied from the lubricating device 90 to push out the first limiting pin 51.

When the force resulting from the hydraulic pressure in the first limiting chamber 55 is smaller than the force of the first limiting spring 53, the first limiting pin 51 is displaced in a direction to project from the vane 36 (hereinafter, "projecting direction ZA"). When the force resulting from the hydraulic pressure in the first limiting chamber 55 is larger than the force of the first limiting spring 53, the first limiting pin 51 is actuated in a direction to be accommodated in the vane 36 (hereinafter, "accommodating direction ZB").

The first engaging groove 60 includes two grooves having different depths, that is, a relatively deep first lower groove 62 and a relatively shallow first upper groove 61. A first step portion 63 is provided between the first lower groove 62 and the first upper groove 61. The first step portion 63 serves as the boundary between these grooves.

An advance-side end portion of the first engaging groove 60, that is, an advance-side end portion (hereinafter, "first advance end portion 62A") of the first lower groove 62, is provided at a portion corresponding to the intermediate phase PM. A retard-side end portion (hereinafter, "first retard end portion 62B") of the first lower groove 62 is provided at a portion corresponding to a first retarded phase PX1 that is retarded with respect to the intermediate phase PM. A retard-side end portion of the first engaging groove 60, that is, a retard-side end portion (hereinafter, "first retard end portion 61A") of the first upper groove 61, is provided at a portion corresponding to a second retarded phase PX2 that is retarded with respect to the first retarded phase PX1.

The retard limiting mechanism 70 includes a second limiting pin 71, a second limiting portion 72 and a second engaging groove 80. The second limiting pin 71 is provided for another one of the vanes 36 so as to be displaceable with respect to the vane 36. The second limiting portion 72 actuates the second limiting pin 71 with respect to the vane 36. The second engaging groove 80 engages the second limiting pin 71. The second limiting portion 72 includes a second accommodating chamber 74 and a second limiting spring 73. The second accommodating chamber 74 is formed in the vane 36. The second limiting spring 73 presses the second limiting pin 71 in one direction. The second accommodating chamber 74 includes a second spring chamber 76 and a second limiting chamber 75. The second spring chamber 76 accommodates the second limiting spring 73. The second limiting chamber 75 receives lubricating oil supplied from the lubricating device 90 to push out the second limiting pin 71.

When the force resulting from the hydraulic pressure in the second limiting chamber 75 is smaller than the force of the second limiting spring 73, the second limiting pin 71 is displaced in the projecting direction ZA. When the force resulting from the hydraulic pressure in the second limiting chamber 75 is larger than the force of the second limiting spring 73, the second limiting pin 71 is displaced in the accommodating direction ZB.

The second engaging groove 80 includes two grooves, that is, a second retard upper groove 81 and a second advance upper groove 82, and an engaging hole 83. The second retard upper groove 81 and the second advance upper groove 82 have the same depth and extend in different directions with respect to the intermediate phase PM. The second retard upper groove 81 is provided at a portion that is retarded with respect to the intermediate phase PM. The second advance upper groove 82 is provided at a portion that is advanced with respect to the intermediate phase PM. The engaging hole 83 is deeper than these upper grooves 81 and 82. The engaging hole 83 is provided at a portion corresponding to the intermediate phase PM.

An advance-side end portion of the second engaging groove 80, that is, an advance-side end portion (hereinafter, "second advance end portion 82A") of the second advance upper groove 82, is provided at a portion corresponding to an advanced phase PY that is advanced with respect to the intermediate phase PM. A retard-side end portion (hereinafter, "second retard end portion 81A") of the second retard upper groove 81 is provided at a portion corresponding to a third retarded phase PX3 that is retarded with respect to the second retarded phase PX2.

Figure 4A:
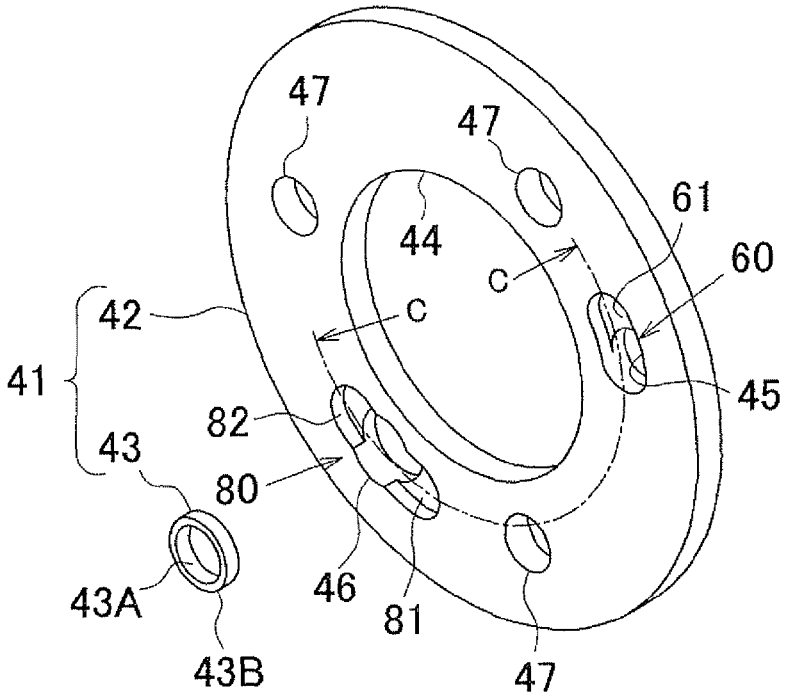
FIG. 4A is a perspective view of an engaging plate of the variable valve timing mechanism according to the embodiment.

The structure of the engaging plate 41 of the housing rotor 31 will be described with reference to FIG. 4A and FIG. 4B. The engaging plate 41 includes a disc-shaped plate body 42 and a detachable bushing 43. The detachable bushing 43 is assembled to the plate body 42. The plate body 42 has the first engaging groove 60, the second engaging groove 80, a shaft hole 44 and fastening holes 47. The first limiting pin 51 is fitted in the first engaging groove 60. The second limiting pin 71 is fitted in the second engaging groove 80. The intake camshaft 22 is inserted through the shaft hole 44. Bolts for fastening the plate body 42 to the sprocket 33 are respectively inserted through the fastening holes 47. The first engaging groove 60 has the first upper groove 61 and a first hole 45 corresponding to the first lower groove 62. The second engaging groove 80 has the second retard upper groove 81, the second advance upper groove 82 and a second hole 46 in which the detachable bushing 43 is fitted.

The first hole 45 is substantially the same as the first lower groove 62 in plan view. That is, one of openings of the first hole 45 is closed by the sprocket 33 to form the first lower groove 62. The second hole 46 has a cylindrical shape. The second hole 46 has an inside diameter that is equal to the outside diameter of the detachable bushing 43.

The detachable bushing 43 has a through hole 43A. The axial length of the detachable bushing 43 is equal to the thickness of the bottom of the second retard upper groove 81. The through hole 43A is provided coaxially with the central axis of the detachable bushing 43. The inside diameter of the through hole 43A is larger than the outside diameter of the second limiting pin 71. The outside diameter of the detachable bushing 43 and the inside diameter of the second hole 46 are set to substantially the same size. The detachable bushing 43 is assembled in the second hole 46.

Figure 4B:
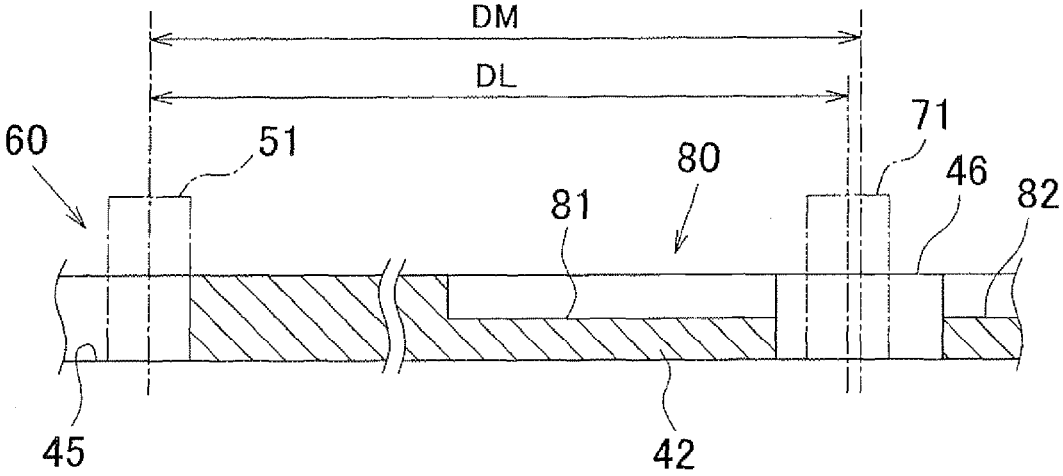
FIG. 4B is a developed cross-sectional view that shows the cross-sectional view of the engaging plate of the variable valve timing mechanism according to the embodiment, taken along the line C-C in FIG. 4A.

As shown in FIG. 4B, where the distance in the circumferential direction between the central axis of the first limiting pin 51 and the central axis of the second limiting pin 71 is a "axis to axis distance DL" and the distance in the circumferential direction between the central axis of the first limiting pin 51 when the first hole 45 engages the first limiting pin 51 and the central axis of the second hole 46 is a "groove to engaging hole distance DM", the groove to engaging hole distance DM is longer than the axis to axis distance DL.

Figure 5A:
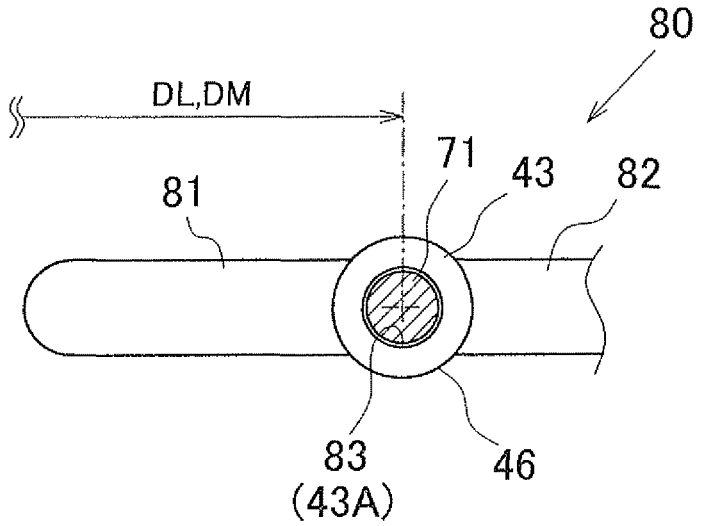
FIG. 5A and FIG. 5B are plan views that respectively show the planar structures of second engaging grooves according to comparative examples of a phase limiting mechanism according to the embodiment.

The case where the axis to axis distance DL is equal to the groove to engaging hole distance DM and the case where the axis to axis distance DL is longer than the groove to engaging hole distance DM will be described with reference to FIG. 5A and FIG. 5B. FIG. 5A is a plan view of the second engaging groove 80 when a predetermined detachable bushing 43 is selected from among a plurality of detachable bushings 43 of different types and then the predetermined detachable bushing 43 is assembled in the second hole 46 in the case where the axis to axis distance DL is equal to the groove to engaging hole distance DM.

When the detachable bushing 43 is selected in accordance with the following selection method, the detachable bushing 43 of which the inside diameter of the through hole 43A (that is, the engaging hole 83) is equal to the outside diameter of the second limiting pin 71 is selected. In this case, there is no clearance CL on an advance side or on a retard side between the second limiting pin 71 and the engaging hole 83. Therefore, this eliminates the effect of releasing engagement resulting from the structure of the two limiting pins. That is, because the limiting pins 51 and 71 each engage the corresponding engaging groove only at one of the advance side and the retard side, the effect that the phase limiting mechanism 40 more quickly releases engagement than the phase limiting mechanism 40 formed of a single limiting pin deteriorates.

Figure 5B:
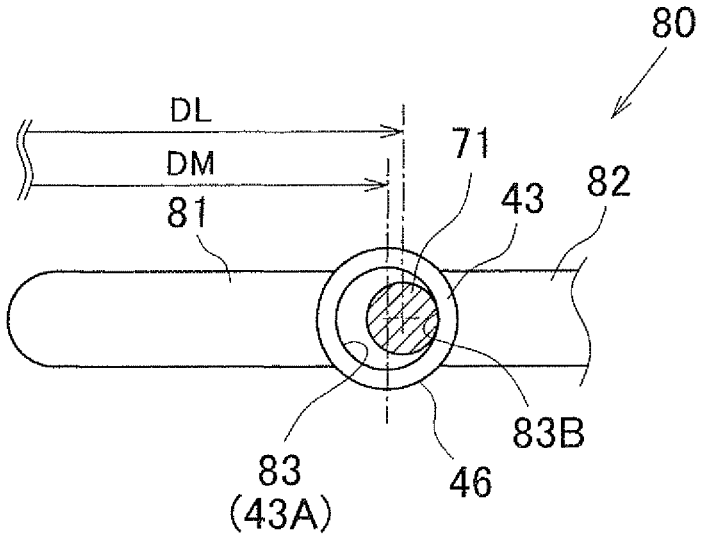

FIG. 5B is a plan view of the second engaging groove 80 when a predetermined detachable bushing 43 is selected from among a plurality of detachable bushings 43 of different types and then the predetermined detachable bushing 43 is assembled in the second hole 46 in the case where the axis to axis distance DL is longer than the groove to engaging hole distance DM.

Because the position of the central axis of the second limiting pin 71 is advanced with respect to the central axis of the second hole 46, when the detachable bushing 43 is selected in accordance with the following selection method, the second limiting pin 71 contacts an advance-side side surface 83B of the engaging hole 83. This impairs the function of limiting rotation of the vane rotor 35 toward the retard side by the second limiting pin 71 and the second engaging groove 80.

For these reasons, as shown in FIG. 4B, the central axis of the second hole 46 is set so that the axis to axis distance DL is shorter than the groove to engaging hole distance DM. Specifically, the central axis of the second hole 46 is set so that the groove to engaging hole distance DM is longer than the maximum allowable axis to axis distance DL between the first limiting pin 51 and the second limiting pin 71 when assembled to the vane rotor 35.

Figure 6:
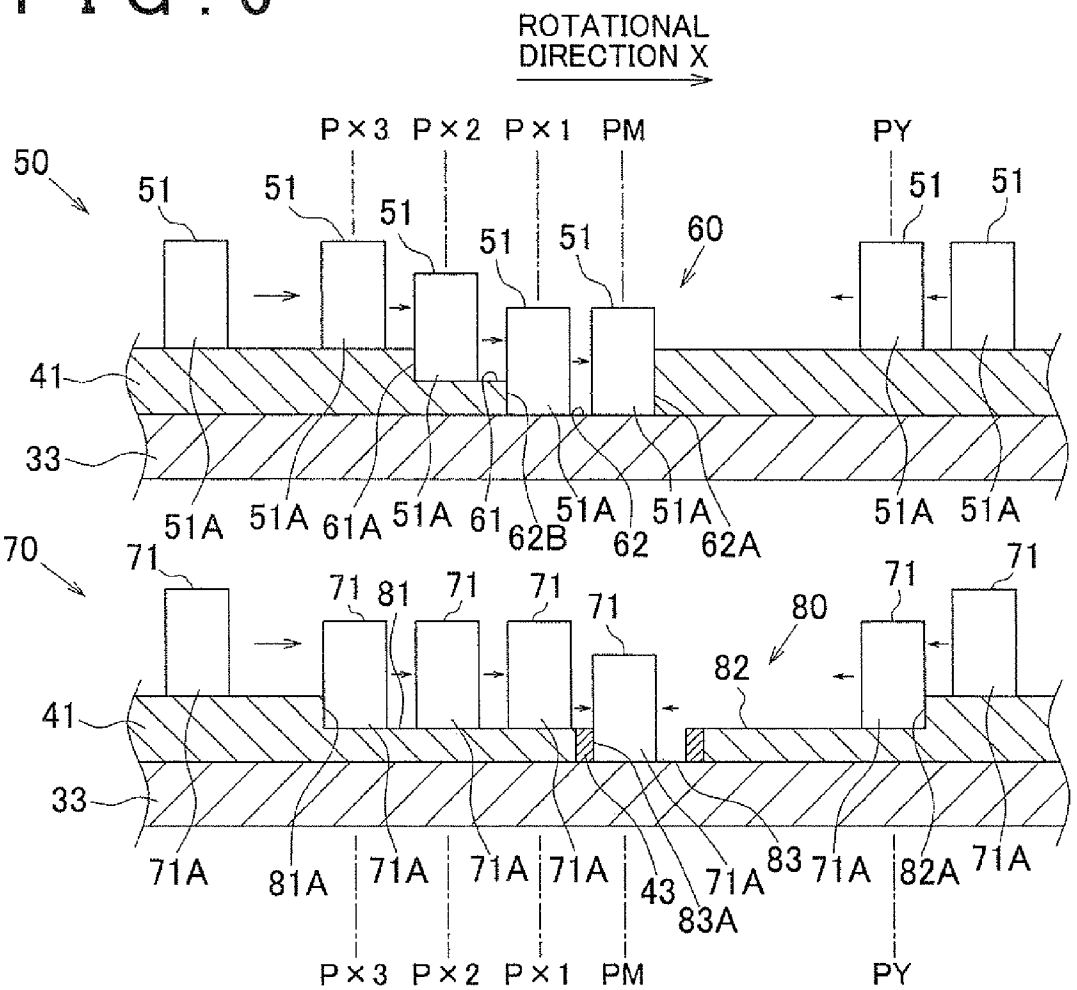
FIG. 6 is a cross-sectional view that shows an advance limiting mechanism (top) and a retard limiting mechanism (bottom) of the variable valve timing mechanism according to the embodiment.

The operation of the phase limiting mechanism 40 when the housing rotor 31 is engaged with the vane rotor 35 will be described with reference to FIG. 6. FIG. 6 shows the positions of the first limiting pin 51 and the positions of the second limiting pin 71 when the vane rotor 35 is set at a predetermined relative rotational phase. Hereinafter, the operation of changing the rotational phase of the vane rotor 35 with respect to the housing rotor 31 toward the intermediate phase PM is termed "intermediate timing locking operation".

The operation (first operation) of the phase limiting mechanism 40 when the intermediate timing locking operation is performed while the valve timing VT is retarded with respect to the intermediate timing VTmdl will be described. In FIG. 6, the first to fifth file first limiting pins 51 and second limiting pins 71 from the left correspond to this operation.

When the relative rotational phase of the vane rotor 35 is retarded with respect to the third retarded phase PX3, the first limiting pin 51 and the second limiting pin 71 are respectively located outside the first engaging groove 60 and the second engaging groove 80.

When the rotational phase of the vane rotor 35 has reached the third retarded phase PX3, the second limiting pin 71 further projects from the vane 36 and then the pin distal end portion 71A fits in the second retard upper groove 81. At this time, the first limiting pin 51 is located outside the first engaging groove 60. When the phase limiting mechanism 40 is placed in this state, rotation of the vane rotor 35 toward the retard side beyond the third retarded phase PX3 with respect to the housing rotor 31 is limited.

When the rotational phase of the vane rotor 35 has reached the second retarded phase PX2, the first limiting pin 51 further projects from the vane 36 and then the pin distal end portion 51A fits in the first upper groove 61. At this time, the second limiting pin 71 is located in the second retard upper groove 81. When the phase limiting mechanism 40 is placed in this state, rotation of the vane rotor 35 toward the retard side beyond the second retarded phase PX2 with respect to the housing rotor 31 is limited.

When the rotational phase of the vane rotor 35 has reached the first retarded phase PX1, the pin distal end portion 51A fits in the first lower groove 62. At this time, the second limiting pin 71 is located in the second retard upper groove 81. When the phase limiting mechanism 40 is placed in this state, rotation of the vane rotor 35 toward the retard side beyond the first retarded phase PX1 with respect to the housing rotor 31 is limited.

When the rotational phase of the vane rotor 35 has reached the intermediate phase PM, the pin distal end portion 71A of the second limiting pin 71 fits in the engaging hole 83. At this time, an advance-side side surface of the pin distal end portion 51A of the first limiting pin 51 contacts the first advance end portion 62A of the first lower groove 62. In addition, a retard-side side surface of the pin distal end portion 71A of the second limiting pin 71 contacts a retard-side side surface 83A of the engaging hole 83. That is, rotation toward the advance side beyond the intermediate phase PM is limited by the engagement of the first limiting pin 51 with the first advance end portion 62A, and rotation toward the retard side beyond the intermediate phase PM is limited by the engagement of the second limiting pin 71 with the engaging hole 83. By so doing, relative rotation of the vane rotor 35 with respect to the housing rotor 31 is limited, and the valve timing VT is locked at the intermediate timing VTmdl.

Next, the operation (second operation) of the phase limiting mechanism 40 when the intermediate timing locking operation is performed while the valve timing VT is advanced with respect to the intermediate timing VTmdl will be described. When the electronic control unit 101 receives a request to lock the valve timing VT at the intermediate timing VTmdl in a state where the valve timing VT is advanced with respect to the intermediate timing VTmdl, the vane rotor 35 rotates toward the retard side with respect to the housing rotor 31 in a state where the first limiting pin 51 and the second limiting pin 71 are respectively accommodated in the corresponding vanes 36. Subsequently, when the valve timing VT has reached a timing that is retarded with respect to the intermediate timing VTmdl, the first limiting pin 51 and the second limiting pin 71 are maintained so as to project from the corresponding vanes 36, and then the vane rotor 35 rotates toward the advance side with respect to the housing rotor 31. After that, as in the case of the first operation, the advance limiting mechanism 50 and the retard limiting mechanism 70 operate.

Next, the intermediate timing locking operation (third operation) of the phase limiting mechanism 40 when the hydraulic pressure of lubricating oil is low and the valve timing VT is advanced with respect to the intermediate timing VTmdl will be described. In FIG. 6, the first to third file first limiting pins 51 and second limiting pins 71 from the right correspond to the following operations.

When the hydraulic pressure of lubricating oil is low at the time of engine start, the hydraulic pressure of lubricating oil in the first limiting chamber 55 and the second limiting chamber 75 is lower than the hydraulic pressure required to accommodate the first limiting pin 51 and the second limiting pin 71 in the accommodating chambers, so the first limiting pin 51 and the second limiting pin 71 are maintained so as to project from the corresponding vanes 36. Because no lubricating oil is supplied to the advance chambers 38 or the retard chambers 39, the vane rotor 35 oscillates with respect to the housing rotor 31. In addition, the vane rotor 35 receives a load of the intake valve 21 via an intake cam. Therefore, when the housing rotor 31 rotates by cranking at the time of engine start, the vane rotor 35 rotates toward the retard side with respect to the housing rotor 31. At this time, the advance limiting mechanism 50 and the retard limiting mechanism 70 operate as follows.

When the relative rotational phase of the vane rotor 35 is advanced with respect to the advanced phase PY, the first limiting pin 51 and the second limiting pin 71 are respectively located outside the first engaging groove 60 and the second engaging groove 80.

When the relative rotational phase of the vane rotor 35 has reached the advanced phase PY, the second limiting pin 71 projects from the vane 36 and then the pin distal end portion 71A fits in the second advance upper groove 82. At this time, the first limiting pin 51 is located outside the first engaging groove 60. When the phase limiting mechanism 40 is placed in this state, rotation of the vane rotor 35 toward the advance side beyond the advanced phase PY with respect to the housing rotor 31 is limited.

When the relative rotational phase of the vane rotor 35 has reached the intermediate phase PM, the first limiting pin 51 projects from the vane 36 and then the pin distal end portion 51A fits in the first lower groove 62, and the second limiting pin 71 projects from the vane 36 and then the pin distal end portion 71A fits in the engaging hole 83. At this time, a side surface of the pin distal end portion 51A of the first limiting pin 51 contacts the first advance end portion 62A of the first lower groove 62. In addition, a retard-side side surface of the pin distal end portion 71A of the second limiting pin 71 contacts a retard-side side surface 83A of the engaging hole 83. That is, the valve timing VT is locked at the intermediate timing VTmdl by the engagement of the first limiting pin 51 with the first advance end portion 62A and the engagement of the second limiting pin 71 with the retard-side side surface 83A.

Next, the operation (fourth operation) of the phase limiting mechanism 40 when the intermediate timing locking operation is performed while the hydraulic pressure of lubricating oil is low and the valve timing VT is retarded with respect to the intermediate timing VTmdl will be described.

The states of the variable valve timing mechanism 30 and phase limiting mechanism 40 at the time of engine start are the same as the states described in the third operation. That is, the first limiting pin 51 and the second limiting pin 71 are maintained so as to project from the corresponding vanes 36, and the vane rotor 35 oscillates with respect to the housing rotor 31. In addition, when the housing rotor 31 rotates by cranking at the time of engine start, the vane rotor 35 relatively oscillates with respect to the housing rotor 31. When the relative rotational phase of the vane rotor 35 has reached the third retarded phase PX3, the pin distal end portion 71A fits in the second retard upper groove 81. When the relative rotational phase of the vane rotor 35 has reached the second retarded phase PX2, the pin distal end portion 51A fits in the first upper groove 61. When the relative rotational phase of the vane rotor 35 has reached the first retarded phase PX1, the pin distal end portion 51A fits in the first lower groove 62. Furthermore, when the vane rotor 35 relatively oscillates with respect to the housing rotor 31 and then the relative rotational phase of the vane rotor 35 has reached the intermediate phase PM, the pin distal end portion 71A fits in the engaging hole 83. Thus, the valve timing VT is locked at the intermediate timing VTmdl.

Incidentally, in order to engage the vane rotor 35 with the housing rotor 31 without generating noise, it is required to maintain a state where the first limiting pin 51 contacts the first advance end portion 62A and the second limiting pin 71 contacts the retard-side side surface 83A of the engaging hole 83 or to set the clearance CL between the second limiting pin 71 and the retard-side side surface 83A of the engaging hole 83 within a predetermined range.

However, individual products have variations in distance between the first limiting pin 51 and the second limiting pin 71 because of the dimensional tolerances and assembly errors of components, so the clearance CL may be larger than the predetermined range. In this embodiment, in the assembling process of the variable valve timing mechanism 30, the detachable bushing 43 is used to adjust the clearance CL so that the clearance CL falls within the predetermined range.

The details of a method of adjusting the clearance CL using the detachable bushing 43 will be described with reference to FIG. 7A and FIG. 7B. Note that, hereinafter, the distance between a portion of the side surface of the first limiting pin 51, which contacts the first advance end portion 62A, and a portion of the side surface of the second limiting pin 71, which contacts the retard-side side surface 83A of the engaging hole 83, is defined as a "pin to pin distance DA". In addition, the distance in the circumferential direction between the first advance end portion 62A of the first engaging groove 60 and the retard-side side surface 83A of the engaging hole 83 is defined as an "engagement to engagement distance DBA". In addition, the distance between the first advance end portion 62A of the first engaging groove 60 and a most retard-side side surface portion 46A of the inner periphery of the second hole 46 in the engaging plate 41 is defined as an "groove to groove distance DBB". In addition, in a state where the first limiting pin 51 is in contact with the first advance end portion 62A of the first lower groove 62, the distance between the second limiting pin 71 and the retard-side side surface 83A of the engaging hole 83 is defined as the "clearance CL".

The variable valve timing mechanism 30 is assembled through the following Process 1 to Process 5.

(Process 1)

A vane rotor 35 to be assembled to the housing rotor 31 is selected. That is, the housing rotor 31 and the vane rotor 35 are paired.

(Process 2)

The pin to pin distance DA that is the distance between the first limiting pin 51 and second limiting pin 71 of the vane rotor 35 is measured. Specifically, the pin to pin distance DA is measured along the path in which the first limiting pin 51 and the second limiting pin 71 are displaced when the vane rotor 35 relatively rotates with respect to the housing rotor 31.

(Process 3)

The groove to groove distance DBB is measured. The groove to groove distance DBB is measured along the path in which the first limiting pin 51 and the second limiting pin 71 are displaced when the vane rotor 35 relatively rotates with respect to the housing rotor 31. Then, a distance difference DC that is the difference between the pin to pin distance DA and the groove to groove distance DBB is obtained on the basis of the pin to pin distance DA and the groove to groove distance DBB.

(Process 4)

A detachable bushing 43 of which a thick portion 43B has a size that is smaller than the distance difference DC and closest to the distance difference DC is selected from a group of a plurality of detachable bushings 43 of different types, prepared in advance.

(Process 5)

The selected detachable bushing 43 is fitted into the second hole 46 of the engaging plate 41. After that, the first limiting pin 51 is fitted into the first engaging groove 60, and the second limiting pin 71 is fitted into the second engaging groove 80 to thereby assemble the housing rotor 31 to the vane rotor 35.

The procedure of selecting the detachable bushing 43 will be described with reference to FIG. 7A to FIG. 8B. FIG. 7A and FIG. 7B show the dimensional relationship of the detachable bushing 43 when the distance difference DC between the pin to pin distance DA and the groove to groove distance DBB is a distance DCA. FIG. 5A and FIG. 88 show the dimensional relationship of the detachable bushing 43 when the distance difference DC is a distance DCB.

Figure 7A:
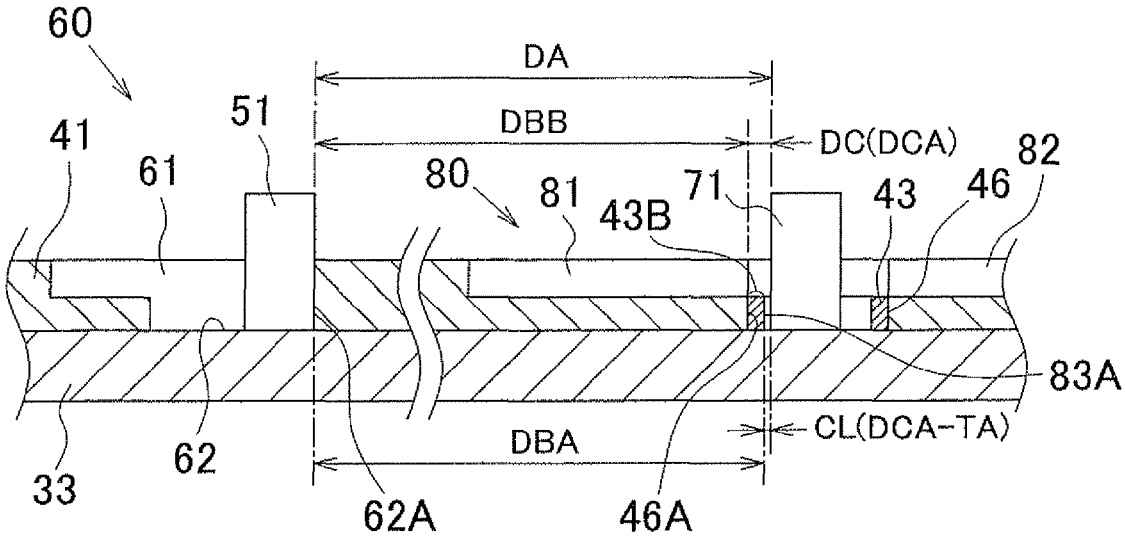
FIG. 7A is a cross-sectional view of the phase limiting mechanism according to the embodiment in a state where limiting pins respectively engage engaging grooves.
Figure 7B:
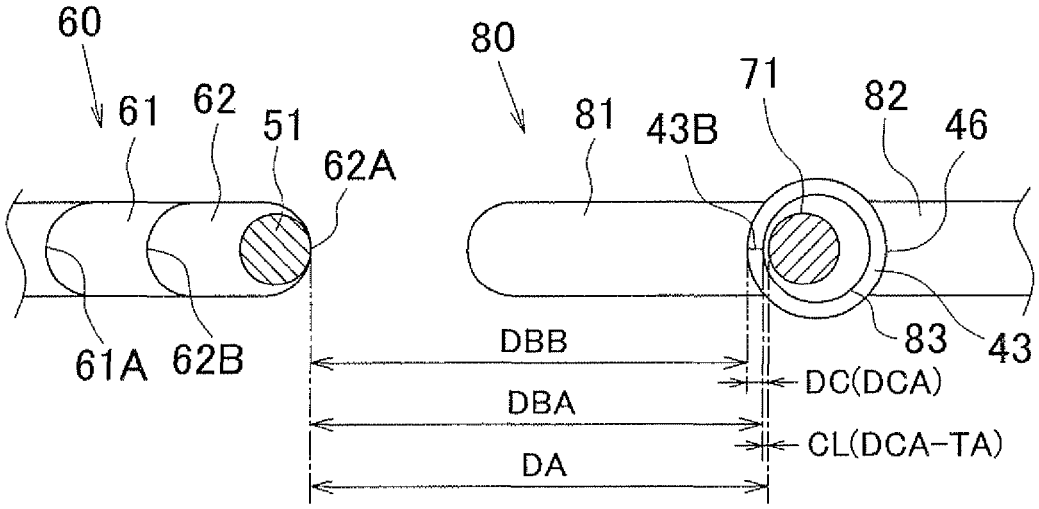
FIG. 7B is a plan view of the phase limiting mechanism according to the embodiment in a state where the limiting pins respectively engage the engaging grooves.

As shown in FIG. 7A and FIG. 78, when the distance difference DC between the pin to pin distance DA and the groove to groove distance DBB is a distance DCA, the detachable bushing 43 of which the thick portion 43B has a thickness TA smaller than the distance DCA is selected. At this time, the engagement to engagement distance DBA is the sum of the groove to groove distance DBB and the thickness TA of the thick portion 43B of the detachable bushing 43. Therefore, the clearance CL between the second limiting pin 71 and the retard-side side surface 83A of the engaging hole 83 is a difference between the pin to pin distance DA and the engagement to engagement distance DBA, that is, a difference between the distance DCA of the distance difference DC and the thickness TA of the thick portion 43B.

Figure 8A:
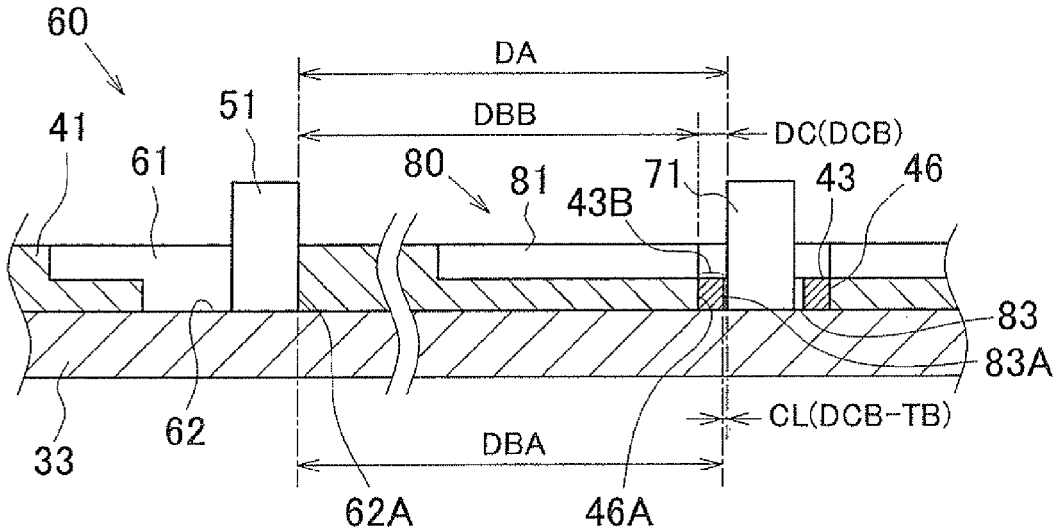
FIG. 8A is a cross-sectional view of the phase limiting mechanism according to the embodiment in a state where the limiting pins respectively engage the engaging grooves.
Figure 8B:
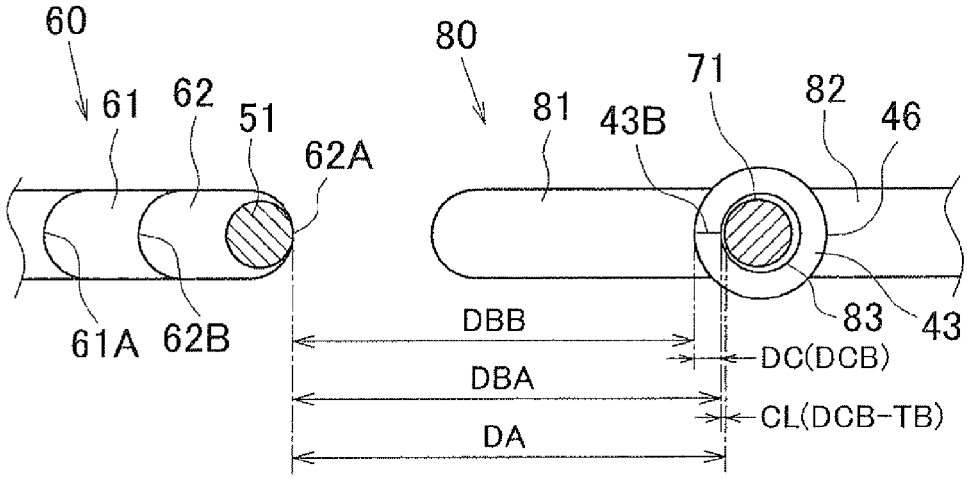
FIG. 8B is a plan view of the phase limiting mechanism according to the embodiment in a state where the limiting pins respectively engage the engaging grooves.

As shown in FIG. 8A and FIG. 8B, when the distance difference DC between the pin to pin distance DA and the groove to groove distance DBB is a distance DCB that is shorter than the distance DCA, the detachable bushing 43 of which the thick portion 43B has a thickness TB smaller than the distance DCB is selected. At this time, the engagement to engagement distance DBA is the sum of the groove to groove distance DBB and the thickness TB of the thick portion 43B of the detachable bushing 43. Therefore, the clearance CL between the second limiting pin 71 and the retard-side side surface 83A of the engaging hole 83 is a difference between the pin to pin distance DA and the engagement to engagement distance DBA, that is, a difference between the distance DCB of the distance difference DC and the thickness TB of the thick portion 43B.

Figure 9:
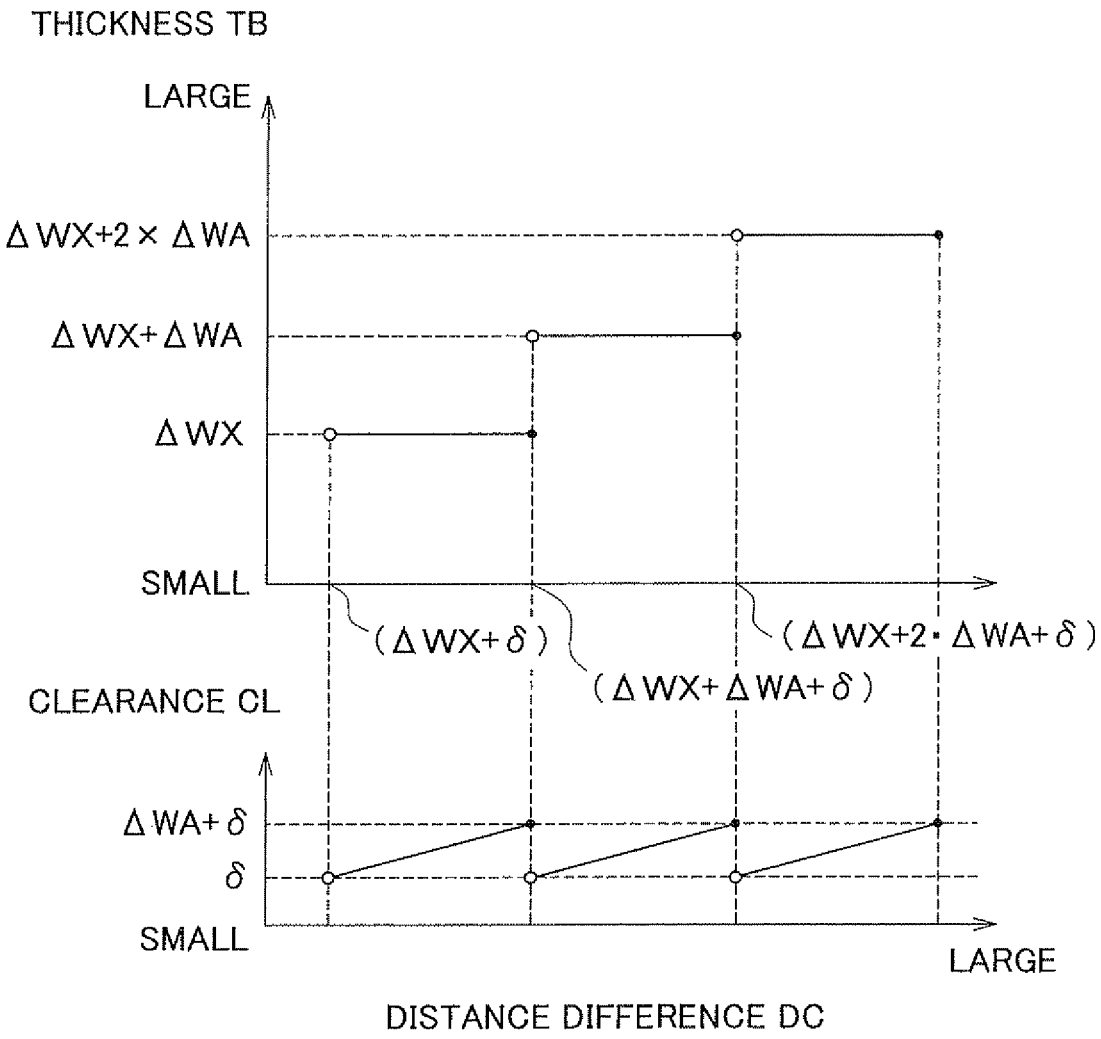
FIG. 9 is a graph that shows the correlation between a clearance and the thickness of a detachable bushing in the phase limiting mechanism according to the embodiment.

A method of selecting the detachable bushing 43 using a map will be described with reference to FIG. 9. The map shows the correlation between the distance difference DC and the thickness TB of the thick portion 43B of the detachable bushing 43 to be selected for the distance difference DC. Here, an example of a method of selecting the detachable bushing 43 so that the adjusted clearance CL ranges from a distance "ΔWA+δ" to a distance "δ" will be described. Note that the distance δ is given as a distance required for the first limiting pin 51 to engage the first engaging groove 60 and for the second limiting pin 71 to engage the second engaging groove 80. The distance ΔWA is given as a maximum allowable value of the clearance CL that causes noise.

A plurality of detachable bushings 43 of different types are prepared so that the minimum thickness of the thick portion 43B is ΔWX and the thicknesses are varied in the distance ΔWA. That is, the prepared detachable bushings 43 include the detachable bushing 43 of which the thick portion 43B has the minimum thickness ΔWX, the detachable bushing 43 of which the thick portion 43B has a thickness of the sum of the minimum thickness ΔWX and the distance ΔWA and the detachable bushing 43 of which the thick portion 43B has a thickness of the sum of the minimum thickness ΔWX and twice the distance ΔWA, that is (ΔWX, ΔWX+ΔWA and ΔWX+2×ΔWA, . . . ).

When the distance difference DC between the pin to pin distance DA and the groove to groove distance DBB is larger than "ΔWX+δ" and smaller than or equal to "ΔWX+ΔWA+δ", the detachable bushing 43 of which the thick portion 43B has the minimum thickness ΔWX is selected. At this time, the clearance CL between the second limiting pin 71 and the engaging hole 83 falls within the range of the distance "δ" to the distance "ΔWA+δ".

When the distance difference DC between the pin to pin distance DA and the groove to groove distance DBB is larger than "ΔWX+ΔWA+δ" and smaller than or equal to "ΔWX+2×ΔWA+δ", the detachable bushing 43 of which the thick portion 43B has a thickness of "ΔWX+ΔWA" is selected. The clearance CL between the second limiting pin 71 and the engaging hole 83 falls within the range of the distance "δ" to the distance "ΔWA+δ".

As described above, when the plurality of detachable bushings 43 of different types are prepared so that the size of the thick portion 43B of each detachable bushing 43 is varied in ΔWA and then the detachable bushing 43 is selected in response to the size of the distance difference DC, the clearance CL may fall within the range of the distance δ to the distance ΔWA.

According to the present embodiment, the following functions and advantageous effects may be obtained. The first advantageous effects will be described. In the present embodiment, the phase limiting mechanism 40 has the second engaging groove 80 that is configured to be able to adjust the clearance CL between the second limiting pin 71 and the second engaging groove 80 when the first limiting pin 51 engages the first engaging groove 60.

With the above configuration, the second engaging groove 80 is configured to be able to adjust the clearance CL between the second limiting pin 71 and the side surface 83A of the engaging hole 83 of the second engaging groove 80 when the first limiting pin 51 is engaged with the first advance end portion 62A of the first engaging groove 60, so it is possible to adjust the clearance CL when the variable valve timing mechanism 30 is assembled.

The second advantageous effect will be described. In the present embodiment, the housing rotor 31 that serves as an adjustable rotor of which a portion that engages the second limiting pin 71 is adjusted includes the engaging plate 41 that has the second engaging groove 80 (adjustable engaging groove) and the detachable bushing 43 that is formed separately from the engaging plate 41 (body member) and that has the side surface 83A of the engaging hole 83 (through hole 43A).

With the above configuration, the detachable bushing 43 is assembled to the engaging plate 41 to form the second engaging groove 80. In addition, the plurality of detachable bushings 43 of different types are selectable, so it is possible to adjust the clearance CL between the retard-side side surface 83A (adjustable engaging portion) of the engaging hole 83 and the second limiting pin 71 that engages the side surface 83A.

The third advantageous effect will be described. In the present embodiment, the second engaging groove 80 includes a groove formed in the engaging plate 41 and the second hole 46 (fitted portion) in which the detachable bushing 43 fits. The detachable bushing 43 has the engaging hole 83 (through hole 43A) that serves as the adjustable engaging portion, and the diameter of the engaging hole 83 is larger than the outside diameter of the second limiting pin 71.

With the above configuration, the inside diameter of the engaging hole 83 is larger than the outside diameter of the second limiting pin 71, so it is possible to quickly release engagement as compared with the configuration that the inside diameter of the engaging hole 83 is equal to the outside diameter of the second limiting pin 71.

The fourth advantageous effect will be described. In the present embodiment, the distance between an end surface, adjacent to the first limiting pin 51, of an engagement to engagement portion, from which a detachable member is detached, and the second limiting pin 71 is measured as the distance difference DC. After that, the detachable bushing 43 having a thickness TB appropriate for the distance difference DC is selected from among the detachable bushings 43 of different types, and then the selected detachable bushing 43 is assembled to the engaging plate 41.

With the above configuration, the thickness of a portion including the side surface 83A of the engaging hole 83, that is, the thickness TB of the detachable bushing 43, is changed to change the distance between the first advance end portion 62A (first engaging portion) and the side surface 83A (second engaging portion) of the engaging hole 83. By so doing, the distance between the first advance end portion 62A and the side surface 83A of the engaging hole 83 is adjusted, so it is possible to adjust the clearance CL between the second hole 46 of the second engaging groove 80 and the second limiting pin 71.

Note that the aspect of the invention is not limited to the embodiment described above; it may be, for example, modified into the following alternative embodiments. In addition, the following alternative embodiments are not only applied to the above embodiment but they may be implemented in combination with other alternative embodiments.

In the above embodiment, when the distance difference DC between the pin to pin distance DA and the groove to groove distance DBB is obtained, the pin to pin distance DA and the groove to groove distance DBB are measured and then the distance difference DC is calculated as a difference therebetween; instead, the distance difference DC may be obtained as follows.

That is, the first limiting pin 51 is brought into contact with the first advance end portion 62A to maintain a state where the vane rotor 35 is locked to the housing rotor 31. In this state, the distance between the second limiting pin 71 and the side surface 83A of the engaging hole 83 (detachable engaging portion) is measured. By so doing, the distance difference DC may be obtained.

In the above embodiment, the outer shape of the detachable bushing 43 is circular; instead, the outer shape may be elliptical or quadrangular. Note that the reason why the outer shape of the detachable bushing 43 is circular as in the case of the above embodiment is that the detachable bushing 43 is easily press-fitted and misalignment of the position of the center axis of the through hole 43A rarely occurs as compared with the other shapes.

In the above embodiment, the thickness of the detachable bushing 43 is equal to the thickness of the bottom of the second retard upper groove 81 and the thick portion 43B of the detachable bushing 43 constitutes part of the second retard upper groove 81 and part of the second advance upper groove 82; instead, the thick portion 43B of the detachable bushing 43 may constitute the second retard upper groove 81 and the second advance upper groove 82.

Figure 10:
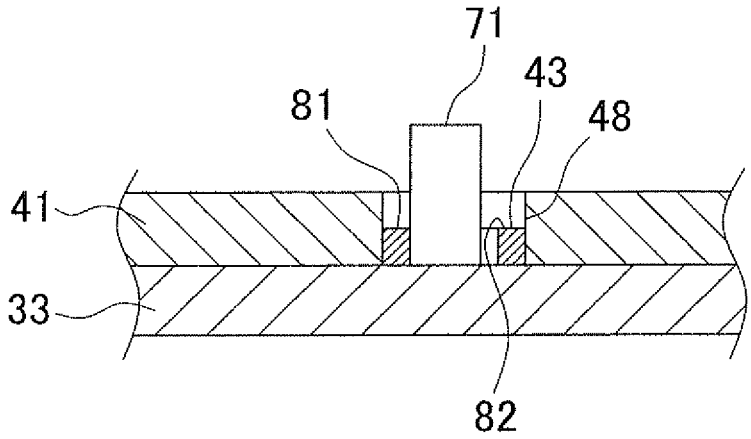
FIG. 10 is a cross-sectional view that shows the cross-sectional structure of a retard limiting mechanism of a phase limiting mechanism according to another embodiment of the invention.

As shown in FIG. 10, the engaging plate 41 has a fitted hole 48 in which the detachable bushing 43 fits. The thickness of the detachable bushing 43 is smaller than the thickness of the engaging plate 41. Thus, the detachable bushing 43 is fitted in the fitted hole 48 to form the second retard upper groove 81 and the second advance upper groove 82.

In the above embodiment, the detachable bushing 43 is attached to the second engaging groove 80 that has the second retard upper groove 81 and the second advance upper groove 82 to form the engaging hole 83; however, the structure of the engaging hole 83 with the detachable bushing 43 does not assume an upper groove.

Figure 11:
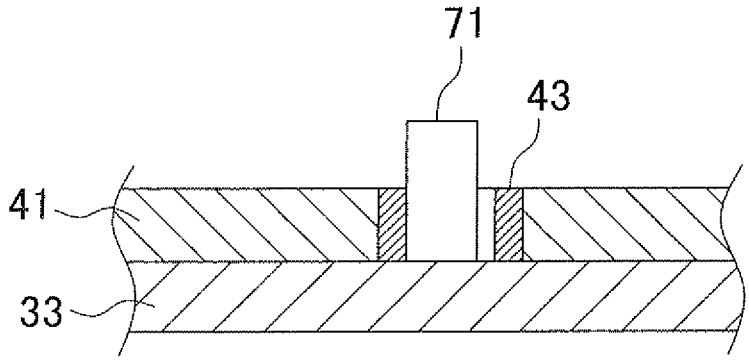
FIG. 11 is a cross-sectional view that shows the cross-sectional structure of a retard limiting mechanism of a phase limiting mechanism according to further another embodiment of the invention.

As shown in FIG. 11, when the second engaging groove 80 is formed of the engaging hole 83 as well, the detachable bushing 43 may be provided. In this case, the thickness of the detachable bushing 43 is equal to the thickness of the engaging plate 41.

In the above embodiment, the detachable bushing 43 is provided in the second engaging groove 80; instead, the detachable bushing 43 may be provided on the first advance end portion 62A of the first engaging groove 60. In this case, the clearance CL between the first limiting pin 51 and the first advance end portion 62A is adjusted.

In the above embodiment, the detachable bushing 43 is provided only in the second engaging groove 80; instead, the detachable bushing 43 may also be provided in the first engaging groove 60. In this case, it is possible to adjust the clearance CL between the first limiting pin 51 and the first advance end portion 62A.

In the above embodiment, the engaging plate 41 has the first engaging groove 60 and the second engaging groove 80; instead, it is applicable that the engaging plate 41 is omitted and the inner surface of the sprocket 33 has the first engaging groove 60 and the second engaging groove 80.

In the above embodiment, the first engaging groove 60 includes the first upper groove 61; instead, the first upper groove 61 may be omitted. In addition, the first engaging groove 60 includes the first upper groove 61 from a portion corresponding to the intermediate phase PM toward the retard side; instead, the first engaging groove 60 may include an upper groove from a portion corresponding to the intermediate phase PM toward the advance side.

In the above embodiment, the variable valve timing mechanism 30 that changes the rotational phase of the vane rotor 35 with respect to the housing rotor 31 by controlling the state where lubricating oil is supplied to or drained from the advance chambers 38 and the retard chambers 39 is employed; however, a structure for changing the rotational phase is not limited to the structure illustrated in the above embodiment. For example, the variable valve timing mechanism 30 includes oil passages that provide fluid communications between the corresponding advance chambers 38 and retard chambers 39 and valves that open or close the respective oil passages in the vane rotor 35, and then lubricating oil is transferred between the advance chambers 38 and the retard chambers 39 via the oil passages to thereby make it possible to change the rotational phase of the vane rotor 35 with respect to the housing rotor 31.

In the above embodiment, the projecting direction ZA and accommodating direction ZB of the first limiting pin 51 are respectively the same as the projecting direction ZA and accommodating direction ZB of the second limiting pin 71; instead, the projecting direction ZA and accommodating direction ZB of the first limiting pin 51 may be respectively opposite to the projecting direction ZA and accommodating direction ZB of the second limiting pin 71

In the above embodiment, the first limiting pin 51 and the second limiting pin 71 are provided for the vane rotor 35, and the first engaging groove 60 and the second engaging groove 80 are provided for the housing rotor 31; instead, it is applicable that the first limiting pin 51 and the second limiting pin 71 are provided for the housing rotor 31 and the first engaging groove 60 and the second engaging groove 80 are provided for the vane rotor 35.

In the above embodiment, the aspect of the invention is applied to the variable valve timing mechanism 30 that changes the valve timing VT of the intake valve 21; instead, the aspect of the invention may be applied to the variable valve timing mechanism 30 that changes the valve timing VT of the exhaust valve 23.

What is claimed is:

1. A variable valve timing device for an internal combustion engine, comprising:

a variable valve timing mechanism that includes an input rotor and an output rotor and that changes a valve timing of at least one of an intake valve and an exhaust valve that serve as engine valves; and a phase limiting mechanism that includes an advance limiting mechanism that engages a first engaging element with a first engaging portion of a first engaging groove to limit rotation of the output rotor toward an advance side beyond a specific phase with respect to the input rotor and a retard limiting mechanism that engages a second engaging element with a second engaging portion of a second engaging groove to limit rotation of the output rotor toward a retard side beyond the specific phase with respect to the input rotor, and that locks a relative rotational phase between the input rotor and the output rotor at the specific phase by the engagement of the first engaging element with the first engaging portion and the engagement of the second engaging element with the second engaging portion, wherein the phase limiting mechanism includes at least one of the second engaging portion that is configured to adjust a clearance between the second engaging element and the second engaging portion when the first engaging element engages the first engaging portion and the first engaging portion that is configured to adjust a clearance between the first engaging element and the first engaging portion when the second engaging element engages the second engaging portion.

2. The variable valve timing device according to claim 1, wherein the at least one of the first engaging portion and the second engaging portion, which is configured to adjust the corresponding clearance, serves as an adjustable engaging portion, at least one of the first engaging groove and the second engaging groove, having the adjustable engaging portion, serves as an adjustable engaging groove, one of the input rotor and the output rotor has the adjustable engaging groove and serves as an adjustable rotor, and the adjustable rotor includes a body member that has the adjustable engaging groove and a detachable member that is formed separately from the body member and that adjusts the clearance at the adjustable engaging portion by serving as a part of the adjustable engaging portion.

3. The variable valve timing device according to claim 2, wherein the adjustable engaging groove includes a groove that is formed in the body member and a fitted portion in which the detachable member is fitted, and the detachable member has a hole as a part of the adjustable engaging portion, and a diameter of the hole is larger than an outside diameter of at least one of the first engaging element and the second engaging element, which engages the adjustable engaging portion.

4. The variable valve timing device according to claim 1, wherein a relative rotational phase between the input rotor and the output rotor when the output rotor is rotated to a most retard side with respect to the input rotor is a most retarded phase, a relative rotational phase between the input rotor and the output rotor when the output rotor is rotated to a most advance side with respect to the input rotor is a most advanced phase, and the specific phase is set between the most retarded phase and the most advanced phase.

5. A manufacturing method for a variable valve timing device for an internal combustion engine, which includes a variable valve timing mechanism that changes a valve timing of at least one of an intake valve and an exhaust valve that serve as engine valves; and a phase limiting mechanism that includes an advance limiting mechanism that engages a first engaging element with a first engaging portion of a first engaging groove to limit rotation of an output rotor toward an advance side beyond a specific phase with respect to an input rotor and a retard limiting mechanism that engages a second engaging element with a second engaging portion of a second engaging groove to limit rotation of the output rotor toward a retard side beyond the specific phase with respect to the input rotor, and that locks a relative rotational phase between the input rotor and the output rotor at the specific phase by the engagement of the first engaging element with the first engaging portion and the engagement of the second engaging element with the second engaging portion, wherein the phase limiting mechanism includes part of the second engaging portion as a detachable member that is formed separately from an adjustable rotor, which is one of the input rotor and the output rotor having the second engaging portion, and allows a thickness of the detachable member to be changed to thereby change a distance between the first engaging portion and the second engaging portion, the manufacturing method comprising:

engaging the first engaging portion with the first engaging element;

after the first engaging portion is engaged with the first engaging element, measuring a distance between an end surface, adjacent to the first engaging element, of the second engaging portion, from which the detachable member is detached, and the second engaging element as a distance difference;

after the distance difference is measured, selecting the detachable member having an appropriate thickness for the distance difference from among detachable members of different types; and assembling the selected detachable member to the adjustable rotor.

6. A manufacturing method for a variable valve timing device for an internal combustion engine, which includes a variable valve timing mechanism that changes a valve timing of at least one of an intake valve and an exhaust valve that serve as engine valves; and a phase limiting mechanism that includes an advance limiting mechanism that engages a first engaging element with a first engaging portion of a first engaging groove to limit rotation of an output rotor toward an advance side beyond a specific phase with respect to an input rotor and a retard limiting mechanism that engages a second engaging element with a second engaging portion of a second engaging groove to limit rotation of the output rotor toward a retard side beyond the specific phase with respect to the input rotor, and that locks a relative rotational phase between the input rotor and the output rotor at the specific phase by the engagement of the first engaging element with the first engaging portion and the engagement of the second engaging element with the second engaging portion, wherein the phase limiting mechanism includes part of the first engaging portion as a detachable member that is formed separately from an adjustable rotor, which is one of the input rotor and the output rotor having the first engaging portion, and allows a thickness of the detachable member to be changed to thereby change a distance between the first engaging portion and the second engaging portion, the manufacturing method comprising:

engaging the second engaging portion with the second engaging element;

after the second engaging portion is engaged with the second engaging element, measuring a distance between an end surface, adjacent to the second engaging element, of the first engaging portion, from which the detachable member is detached, and the first engaging element as a distance difference;

after the distance difference is measured, selecting the detachable member having an appropriate thickness for the distance difference from among detachable members of different types; and assembling the selected detachable member to the adjustable rotor.

* * * * *